United States Patent [19]

Jenski et al.

[11] Patent Number: 4,750,332

[45] Date of Patent: Jun. 14, 1988

[54] REFRIGERATION CONTROL SYSTEM WITH SELF-ADJUSTING DEFROST INTERVAL

[75] Inventors: Leonard W. Jenski, Schaumburg; Raymond M. Paciorek, Darien, both of Ill.

[73] Assignee: Eaton Corporation, Cleveland, Ohio

[21] Appl. No.: 836,358

[22] Filed: Mar. 5, 1986

[51] Int. Cl.[4] ..... F25D 21/00

[52] U.S. Cl. ..... 62/80; 62/155; 62/234

[58] Field of Search ..... 62/155, 80, 156, 234

[56] References Cited

U.S. PATENT DOCUMENTS 4,156,350 5/1979 Elliott et al. ..... 62/80
4,251,988 2/1981 Allard et al. ..... 62/80
4,299,095 11/1981 Cassarino ..... 62/155

FOREIGN PATENT DOCUMENTS 0061530 5/1981 Japan .

*Primary Examiner*—Harry B. Tanner
*Attorney, Agent, or Firm*—Fay, Sharpe, Beall, Fagan, Minnich & McKee

[57] ABSTRACT

A refrigeration control system with self-adjusting defrost interval is provided. The system includes an improved control circuit including an external comparator and a microprocessor having a compressor output drive function and a defrost output drive function. The comparator is linked with the microprocessor with circuit elements for detecting the time period of a defrost operation, comparing the time period with predetermined defrost period limits, generating an output control signal in response to a predetermined relationship between the time period and the limits, and adjusting the defrost interval in response to the control signal whereby the defrost operation is maintained within a preferred preselected time period.

2 Claims, 4 Drawing Sheets

REFRIGERATION CONTROL SYSTEM WITH SELF-ADJUSTING DEFROST INTERVAL

BACKGROUND OF THE INVENTION

This invention pertains to the art of electronic control systems for electrically powered devices and more particularly to an electronic control system for a refrigerator.

The invention is particularly applicable to an electronic control system for a refrigerator to provide a self-adjusting defrost interval whereby the time period for a defrost operation is maintained within a preferred preselected time period. However, it will be appreciated to those skilled in the art that the invention can be readily adapted for use in other environments as, for example, where similar control systems are employed to maintain a preselected temperature and to avoid the accumulation of frost on an evaporator coil of a cooling system.

Accumulation of frost on an evaporator coil of a refrigeration system is a well known problem for which various forms and types of defrost systems have heretofore been suggested and employed all with varying degrees of success. Known technology includes mechanical controls to run the compressor and defrost functions of a refrigerator by electromechanical temperature sensing and motor-geared timing functions. The defrost function was a constant-timed function and occured after a fixed amount of compressor run time.

It is also known to employ electronic control systems which provide an adaptive defrost operation to vary the time period of a defrost operation or alternatively vary the time period of the interval between defrost operations. Such adaptive defrost control systems have typically involved complicated control circuitry which consider a variety of factors including the number and duration of freezer and fresh food door openings, the temperature of the evaporator coil at the beginning of the defrost operation, the duration of the previous defrosting operation, and the total accumulated compressor run time since the previous defrost operation.

For any refrigeration control system there are three primary design objectives. The first is dependability and durability. Since it is intended that the control system will operate continuously, it is necessary that the system be designed with a substantial mean time to failure. Prior known electromechanical control systems or complicated electronic control systems have suffered from the problems of a mean time to failure which has either been commercially unacceptable or was commonly recognized as having a need for substantial improvement. The second overall design objective is simplicity in design and operation. Simplicity in design goes hand-in-hand with durability and dependability but also facilitates ease of manufacture and service. The more complicated prior known control systems which lacked simplicity of design were particularly more costly and difficult to manufacture and similarly more difficult to service. The third overall design objective is cost in manufacture and efficiency in operation. A control system which is more economical to manufacture due to minimization of control components and which provides improved efficiency of operation comprises an improved control system over the more expensive prior known systems.

The present invention contemplates a new and improved refrigeration control system which overcomes the problems of prior known systems and which satisfies the design objectives for such control systems to provide an electronic refrigeration control which is simple in design, economical to manufacture and operate, and which provides optimum efficiency in evaporator coil defrosting and power economy performance by defrosting only when the need exists.

BRIEF SUMMARY OF THE INVENTION

In accordance with the present invention, there is provided a system for electronic refrigeration control in a refrigerator including a refrigerated compartment, a refrigerator compartment thermostat and temperature sensor, a compressor, an evaporator and an evaporator heater comprising means for controlling the time and temperature cycling of the compressor for cooling the refrigerated compartment and means for adjusting the time period of a defrost operation for removing frost from the evaporator. The means for controlling comprises a microprocessor for continuously comparing an output signal from the compartment temperature sensor with the control signal from the compartment thermostat and operating the compressor when the output signal and the control signal bear a predetermined relationship. The microprocessor also continuously verifies the operability of the thermostat and temperature sensor. The means for adjusting also includes the microprocessor which further detects a parameter representing the time period of a defrost operation, compares that parameter with a source of signals representing predetermined defrost period limits, generates an output control signal in response to a predetermined relationship between the parameter and the source of signals, and adjusts the defrost interval in response to the control signal whereby the defrost operation is maintained within a preferred preselected time period.

In accordance with another aspect of the present invention, an improved control circuit for electronic refrigeration control is provided. The circuit includes a single external comparator and a microprocessor. The microprocessor has a compressor output drive function and a defrost output drive function. The comparator is linked to the microprocessor with a defrost temperature-sensing thermistor, a refrigerated compartment temperature-sensing thermistor, a plurality of resistors set for temperature set points and a potentimeter adjustable for a desired refrigeration compartment temperature.

In accordance with a more limited aspect of the present invention, the compressor output drive function and the defrost output drive function are operatively connected to first and second triacs for selective operation of the defrost heater and the compressor.

In accordance with yet another more limited aspect of the present invention, the predetermined defrost limits comprise a defrost period of less than eight minutes and greater than or equal to twelve minutes. Adjusting the defrost interval comprises adding two hours to the defrost interval when the defrost period is less than eight minutes and subtracting two hours when the defrost period is greater than or equal to twelve minutes. The defrost interval is set to a eight hour base period when the defrost period is greater than or equal to sixteen minutes. The defrost interval is limited to a maximum time period of fifty hours and a minimum time period of eight hours. The defrost period is limited to twenty minutes.

One benefit obtained by use of the present invention is a refrigeration control system with a self-adjusting defrost interval which is simpler in design than prior known systems, less costly to manufacture, includes fewer component parts and which has a better mean time to failure than prior known systems.

Another benefit obtained from the present invention is a control system which provides an improved adjustment in a defrost operation and in setting the period for the defrost interval and which offers improved power economy performance by defrosting only when the need exists.

Other benefits and advantages for the subject new refrigeration control system will become apparent to those skilled in the art upon a reading and understanding of this specification.

BRIEF DESCRIPTION OF THE DRAWINGS

The invention may take physical form in certain parts and steps and arrangements of parts and steps, the preferred and alternative embodiments of which will be described in detail in this specification and illustrated in the accompanying drawings which form a part hereof and wherein.

DETAILED DESCRIPTION OF THE INVENTION

Figure 1:
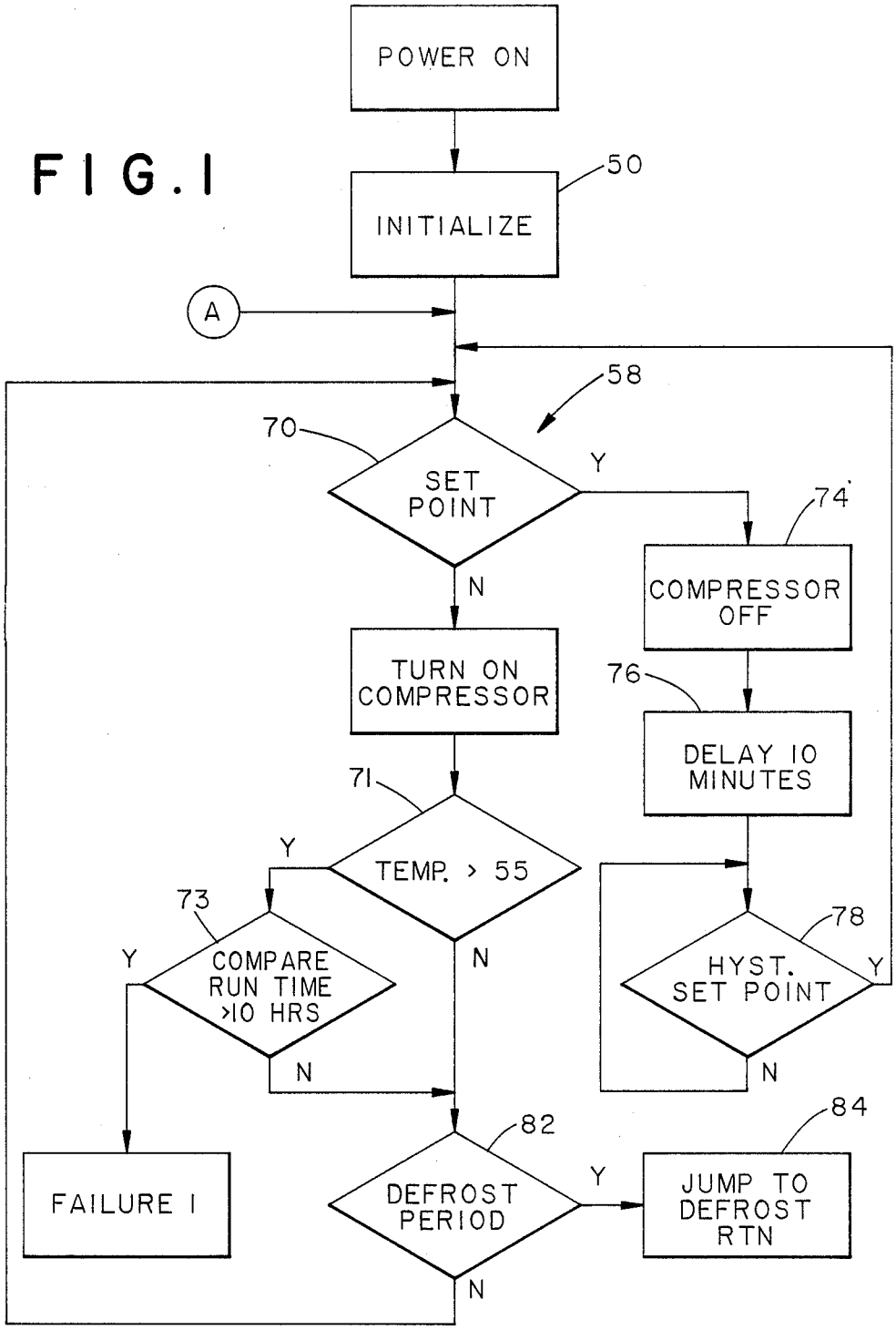
FIGS. 1 and 2 together comprise a flow chart of the control program contained in the logic of the control system.
Figure 2:
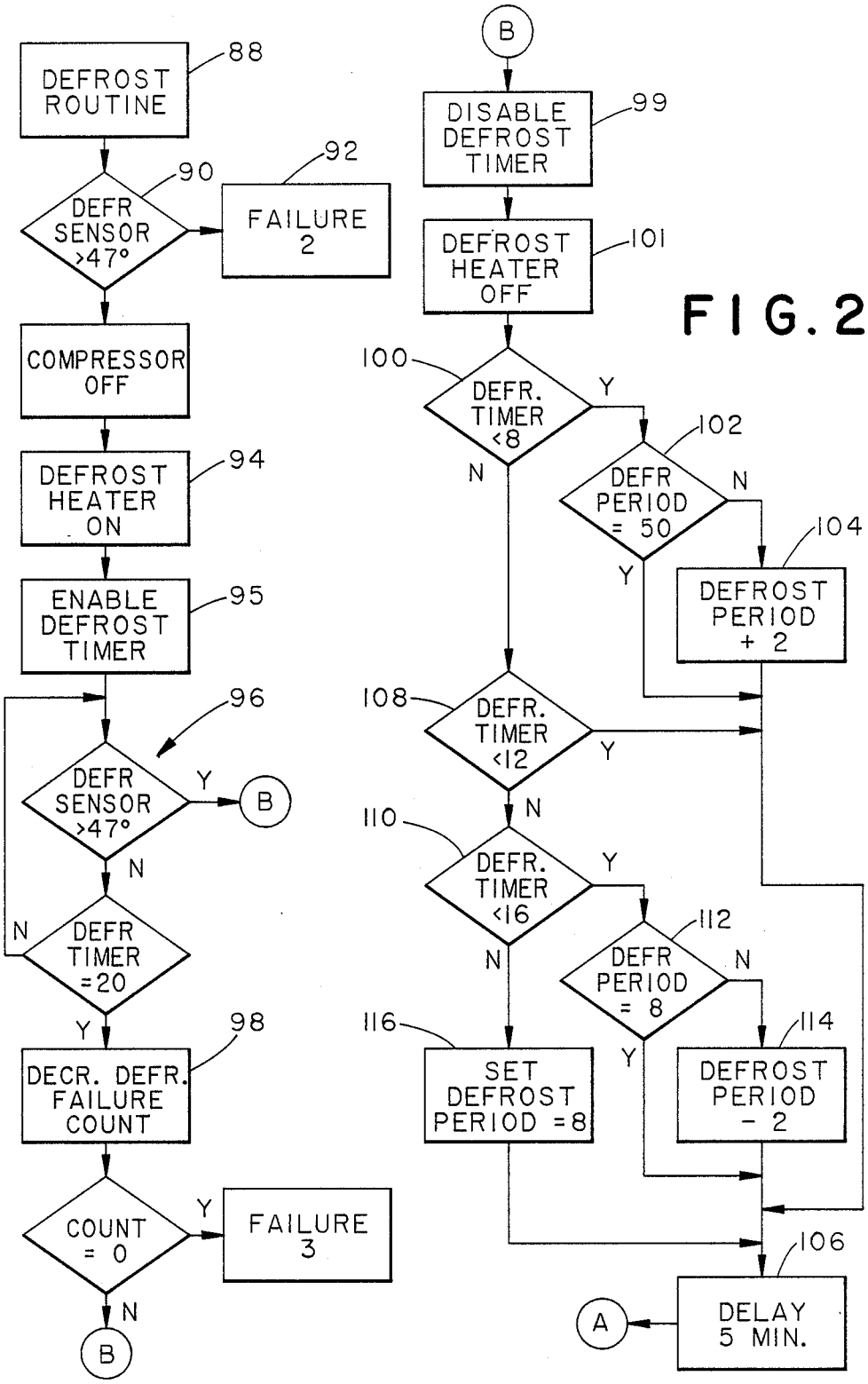

Referring now to the drawings wherein the showings are for purposes of illustrating the preferred and alternative embodiments of the invention only and not for purposes of limiting same, the FIGURES show an electronic control circuit 104 (FIG. 3) for improved electronic refrigeration control of the compressor and defrost functions of the refrigerator through the implementation of a series of steps identified in the flow charts of FIGS. 1 and 2.

In accordance with a control system made according to the subject invention, initially, a fixed defrost time period and time interval is established on power-up of the circuit A. The compressor run time is continually updated and stored in a RAM memory in a microprocessor 52. After the initial interval of compressor run time has been reached, for example ten hours, a defrost routine is performed and timed for reaching a specific evaporator coil temperature, for example 50° F., at the defrost sensor thermistor 56. The time for the defrost operation is compared to predetermined defrost period limits stored in a ROM memory in the microprocessor and an output control signal is generated in response to a predetermined relationship between the actual time of the defrost period and the predetermined defrost period limits. The net effect of the procedure is that the refrigerator control system automatically adjusts the defrost period and the defrost interval according to user requirements. This results in improved power economy performance by defrosting only when the need exists.

Figure 3:
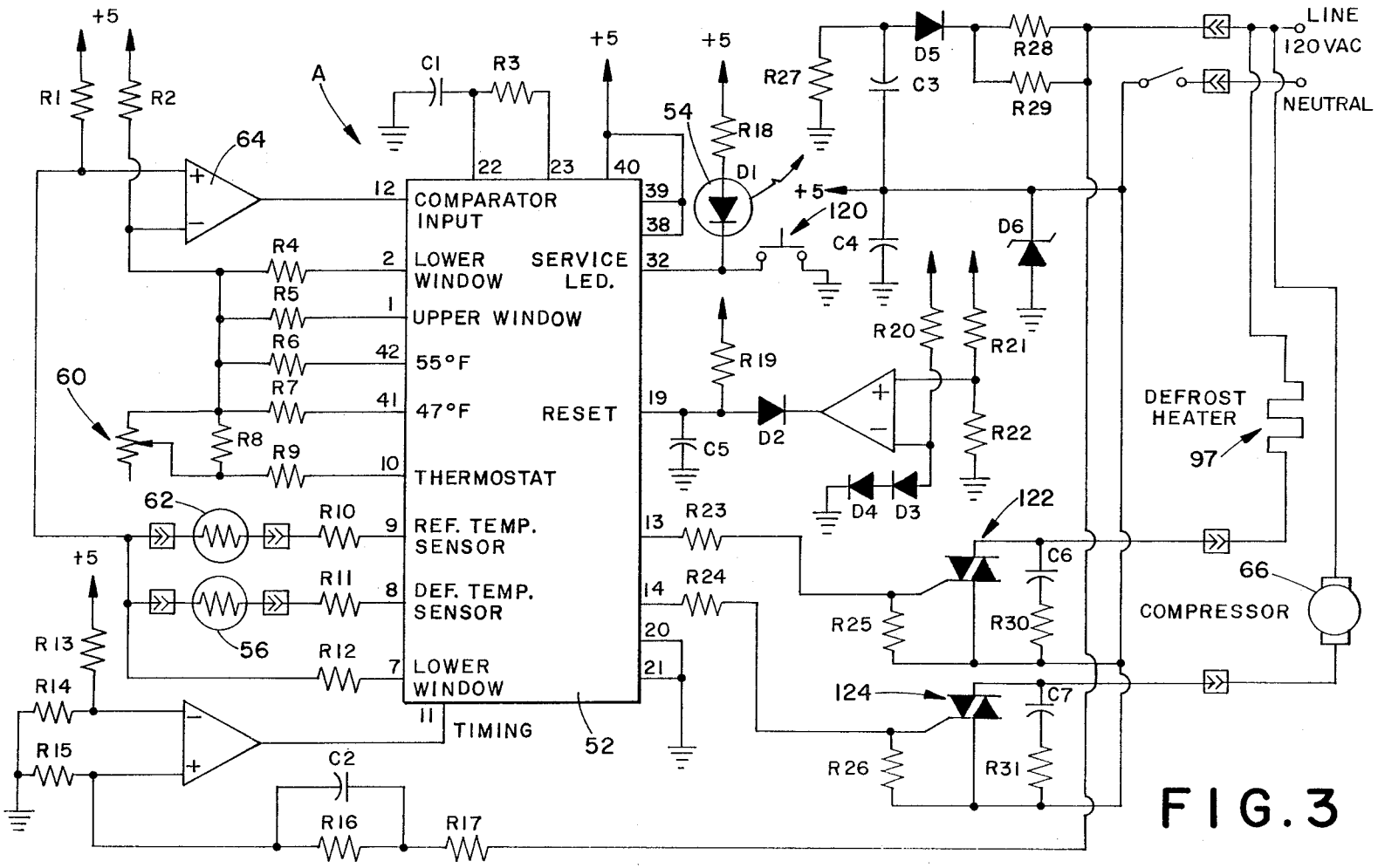
FIG. 3 is a schematic diagram of the control circuit formed in accordance with the present invention.

More specifically and with reference to FIGS. 1, 2 and 3, the functional program flow of the control system is illustrated. The subject system comprises a microprocessor base refrigeration controller software routine comprised of two major loops. The compressor mode loop (FIG. 1) controls the time and temperature cycling of the refrigerator compressor relative to the current thermostat setting. The other major loop is that of the self-adjusting defrost routine (FIG. 2). The software routine continuously checks the hardware of the controller circuit to assure correct operation. In the event that some failure should occur, the corresponding error is logged and an appropriate action is taken to assume reasonable operation until the failure is recognized. Power losses are also tolerated by the controller circuit A with the ability to retain pertinent information for five seconds.

More particularly and with reference to FIG. 1, a power-on or loss of longer than five seconds, the system performs an initialization routine 50 which sets the defrost period to ten hours, the defrost retry count to 3, and clears out the compressor run time in the RAM. The ports of the microprocessor 52 (FIG. 3) are then checked for functional operation. If an error should occur where a port cannot be set or reset, the controller routine abandons further temperature control operation and proceeds to log a fatal error. A fatal error will put the compressor in a ten minute "on" and ten minute "off" cycle. If all microprocessor ports check as functionally operable, then as a visual test the service LED 54 (FIG. 3) will illuminate for approximately two seconds. The defrost sensor, thermistor 56, will then be checked to see if the evaporator coil (not shown) is above 47° F. If not, then a five minute delay is initiated. When the temperature of the evaporator coil is above 47° F., then the compressor mode loop will be entered directly without the five minute delay. Should an error occur with the defrost sensor 56 when being checked in the initialization routine, the defrost function will be disabled, the flashing service LED 54 is enabled, the error is logged and a five minute delay is enabled before entering the compressor mode.

Once initialization 50 and appropriate delays have been completed, the compressor routine 58 is entered. This loop 58 consists of a constant verification of the thermostat potentiometer 60 against opens, the refrigeration temperature sensor 62 against opens or shorts, and also a comparison between the refrigeration temperature sensor 62 and the thermostat 60 at comparator 64 as will be hereinafter more fully discussed. Should an error occur with the thermostat or refrigeration sensor, the system will go into a ten minute on/off compressor cycle and illuminate the service LED 54. A thermostat failure will dictate a board failure. A refrigeration sensor failure will either be an open or short failure. Should an error be detected, an error count is incremented, a delay of 16.6 milliseconds is elapsed and the sensor is re-tested. When the sensor fails thirty-two consecutive times, an error is then logged. In this way, the controller circuit A can detect a real error and ignore errors due to erroneous noise from the environment.

The compressor routine is illustrated in the flow chart of FIG. 1 in the following manner. At the set point block 70, the refrigeration temperature sensor 62 is compared to the thermostat 60 to determine if the sensed temperature is below the temperature set point by comparator 64. If no errors exist and if the temperature is not below the set point, the compressor is turned on 72 and kept on through the loop until the refrigeration sensor temperature is below that set by the thermostat, in which case the compressor is turned off at block 74. After the refrigeration sensor 62 is compared to the thermostat 60 it is checked to verify if the refrigeration compartment temperature is above 55° F. as indicated by block 71. If this condition exists, the accumulated compressor run time is then tested at 73 to see if ten hours has passed. An error is then logged if both conditions prevail, the service LED 54 is illuminated and the system drops into the ten minute on/off cycle mode.

If the compressor is to be turned off, a check is made to see if it was previously enabled. If it was already off, the control is passed back to the start of the compressor mode loop. If the compressor was previously enabled, it is turned off at zero voltage crossing at block step 74 and the compressor run timer in the RAM is disabled. The compressor driver port 14 (FIG. 3) is then tested to verify a drive to the compressor was disabled. If an error occurs, the system jumps to the ten minute on/off cycle routine and the service LED 54 is lighted. Upon successful deactivation of the compressor driver 14, the current accumulated compressor run time is saved and a ten minute delay time 76 is initiated. A hysteresis delay 78 is further made to provide a sufficient window around compressor switching and upon reaching the proper set point, the program jumps back to the beginning of the compressor mode loop 58.

As noted above, when the refrigeration sensor 62 is less than the thermostat 60, the program will enable the compressor run timer in the RAM and enable the compressor 66. The compressor driver port 14 is then tested and if not set correctly, the system will go to a ten minute on/off cycle and light the service LED 54. The compressor run time accumulating in the RAM is now compared at block 82 to the current defrost interval value. The program will return to the beginning of the compressor mode loop 58 if the compared times are not equal. If the times are equal, the program will jump to the defrost routine as indicated at 84.

With particular reference to FIG. 2 and 3, the defrost mode routine 88 begins with a test of the defrost error count. When the count is equal to zero, the program will jump back to the compressor mode loop 58 completely ignoring the defrost function. When the count does not equal zero, the compressor 66 is turned off, a check is made and the appropriate action taken if an error occurs. The defrost routine 88 next checks the defrost sensor 56 to determine if it is above 47° F. as indicated at 90. If the temperature is above 47° F., a defrost error is posted 92 and control is passed to the defrost error routine.

If the defrost sensor 56 is less than 47° F., the program routine continues the defrost function by checking that the compressor 66 is disabled, clearing and enabling the defrost timer 95, enabling the defrost heater 94 and checking the heater for operability. If the defrost heater port 13 does not function correctly, the ten minute on/off cycle is started and the service LED will turn on continuously. If the defroster 97 is operating correctly, the defrost mode continues and a tight loop 96 checks the defrost sensor 47° F. and also checks to see if the defrost heater has been enabled for twenty minutes. If the heater has been enabled for twenty minutes, the defrost loop is terminated and the defrost error count is decremented by one as indicated at 98, and if not zero, the defrost heater is turned off and the defrost timer is disabled. If the defrost error count is equal to zero, a failure is logged.

When the defrost loop 96 is terminated by the defrost sensor 56 reaching 47° F., the defrost error count is reset back to 3, the defrost timer is disabled and the defrost heater is turned off 99, 101. The program routine now checks the length of time that the defrost heater was on. If the time of operation of the defrost heater is less than eight minutes, the defrost interval time period is tested to see if it has reached a maximum of fifty hours. If the interval period has not reached fifty hours, the period is incremented by two hours as indicated by the steps of block 100, 102, 104. The program then proceeds to the end of the defrost mode. Defrost mode termination consists of clearing out the timer memory for a new compressor run time accumulation. A five minute delay 106 is then started and after timeout, control is passed back to the compressor mode loop 58.

If the defrost heater time was determined at check 100 to be greater than or equal to eight minutes, but less than twelve minutes as indicated by check 108, then no change is made in the defrost interval time period. If the defrost heater time is greater than or equal to twelve minutes then it is next checked 110 to determine if it is less than sixteen minutes. If the defrost period is then determined to be between twelve and sixteen minutes, a test is made to check if the defrost interval time period is set at eight hours as indicated at 112. If the defrost interval period is set at eight hours, no change is made. If it is not set at eight hours, the next defrost interval period will be decreased by two hours 114 and the defrost routine proceeds to completion. If the defrost timer is checked at 110 to determine that the defrost time period is greater than sixteen minutes, than the defrost interval time period is set back to eight hours 116 and the defrost mode is accordingly terminated.

All errors jump to one of two error handling routines. Errors for control board failure, temperature sensor open or short circuits and excessive compressor run time jump to a routine which on entry save the error number and jump to the ten minute on/off cycle routine with illumination of the service LED. Errors for a too warm evaporator for defrost attempt, no defrost after three attempts and for defrost sensor open or short circuits jump to a routine which saves the error number, disables the defrost heater, disables any further defrost activity by setting the defrost error count to zero, enables the service LED to flash, and then jumps to the end of the defrost routine.

Two other program loops exist which are not in operation all the time. One of these loops is the power loss routine. During the timer routine which is active every 16.6 milliseconds, a check is made on the status of the power loss routine. This routine saves the service LED status and disables it while also disabling all control outputs. A five second timer is then started, and a loop is initiated which checks the power line then the five second timer. If power returns before five seconds has elapsed, program control is either passed back to the timer routine if the compressor was not active, or if it was active a five minute delay is started and at time out, control is passed back to the compressor mode loop 58. Service LED status is also reinitiated.

When power is off for longer than five seconds, the program drops into a tight loop which waits for the power line to come back, at which time the program will jump to the power on initialization routine (FIG. 1). Either this condition or a hardware reset caused by power to the microprocessor 52 dropping below 3.5 volts, will occur when power is off for longer than five seconds.

The other program loop which may be activated at any time during the operation of the refrigeration controller, is the service loop. This control function is entered by depressing the service switch 120 at any time. The service switch is interrogated during the timer routine and if active, passes control to the service routine. The service routine consists of three consecutive program loops. The first of which is an error code display. This routine displays an error by flashing out the appropriate code. Preferably, the display format for the code is as follows. After depressing the service switch, and releasing the switch, there is a half-second delay then the first digit flashes. After a two-second delay, the second digit of the error code flashes. For example, a two would be two consecutive flashes. After completion of flashing of the error code, there is a six-second delay and the whole sequence repeats itself.

The second program loop, which forces compressor operation, is initiated by depressing the service switch again for approximately fifteen seconds and releasing it. The compressor will turn on, the service LED will light and remain on until the next depression of the service switch.

The last program loop is that of the forced defrost mode which is entered from the compressor operation by again depressing the service switch for approximately one second and releasing. The defrost heater will then turn on if the defrost sensor 56 is less than 47° F., and the service LED will begin to flash. This mode will remain until the defrost sensor reaches 47° F., at which time the service LED 54 will come on continuously and the defrost heater 97 will turn off. This condition will remain until a power off condition exits or another service switch closure is made at which time the program jumps to power on initialization routine.

With particular reference to FIG. 3, the improved control circuit for the subject control system is illustrated in particularity. The circuit A comprises a single external comparator 64 whose input is received at the microprocessor at pin 12. Comparator 64 is linked to the microprocessor 52 with a defrost temperature sensing thermister 56, a refrigerated compartment sensing thermister 62, a plurality of resistors R4 through R12 set for temperature set points and an adjustable potentiometer 60 which is selectively set for a desired refrigerated compartment temperature. The compressor output drive function off of microprocessor pin 14 and the defrost output drive function off of microprocessor pin 13 are operatively connected to first and second triacs 122, 124 for selective operation of the defrost heater 97 and the compressor 66. Op-amp 126 comprises a hardware reset to microprocessor pin 19 caused by VCC dropping below 3.5 volts. Op-amp 128 is employed for timing the microprocessor at pin 11.

The following element values were employed in the circuit of FIG. 3 in one successful embodiment of the invention:

| | | |
|---|---|---|
| R1 | Resistor | 93.1K ohm, 1% film |
| R2 | Resistor | 18.7K ohm, 1% film |
| R3 | Resistor | 33.0K ohm, 1% film |
| R4 | Resistor | 931 ohm, 1% film |
| R5 | Resistor | 27.4K ohm, 1% film |

-continued

| | | |
|---|---|---|
| R6 | Resistor | 3.48K ohm, 1% film |
| R7 | Resistor | 4.32K ohm, 1% film |
| R8 | Resistor | 3.74K ohm, 1% film |
| R9 | Resistor | 5.36K ohm, 1% film |
| R10 | Resistor | 270 ohm, 1% film |
| R11 | Resistor | 270 ohm, 1% film |
| R12 | Resistor | 44.1K ohm, 1% film |
| R13 | Resistor | 750K ohm, 1% film |
| R14 | Resistor | 1.0K ohm, 1% film |
| R15 | Resistor | 510 ohm, 1% film |
| R16 | Resistor | 47K ohm, 5% carbon |
| R17 | Resistor | 330K ohm, 5% carbon |
| R18 | Resistor | 270 ohm, 5% carbon |
| R19 | Resistor | 750K ohm, 1% film |
| R20 | Resistor | 47K ohm, 5% carbon |
| R21 | Resistor | 60.4K ohm, 1% film |
| R22 | Resistor | 24.3K ohm, 1% film |
| R23 | Resistor | 470 ohm, 5% carbon |
| R24 | Resistor | 470 ohm, 5% carbon |
| R25 | Resistor | 1K ohm, 5% carbon |
| R26 | Resistor | 1K ohm, 5% carbon |
| R27 | Resistor | 1K ohm, 5% carbon |
| R28 | Resistor | 6.8K ohm, 5% carbon, ½ Watt |
| R29 | Resistor | 6.8K ohm, 5% carbon, ½ Watt |
| R30 | Resistor | 100 ohm, 5% carbon |
| R31 | Resistor | 100 ohm, 5% carbon |
| R32 | Resistor | 2 Meg ohm, 5% carbon |
| R33 | Resistor | 120K ohm, 5% carbon |
| C1 | Capacitor | mica, 62 picofarad |
| C2 | Capacitor | polyester, 0.1 microfarad |
| C3 | Capacitor | electrolytic, 4000 microfarad |
| C4 | Capacitor | electrolytic, 100 microfarad |
| C5 | Capacitor | polyester, 0.1 microfarad |
| C6 | Capacitor | polyester, 0.1 mf/600 V |
| C7 | Capacitor | polyester, 0.1 mf/600 V |
| D1 | Diode | zener, 5.1 V |
| D2, D3, D4, D6 | | 1N4148 |
| D5 | Rectifier | 1N4005 |

Figure 4:
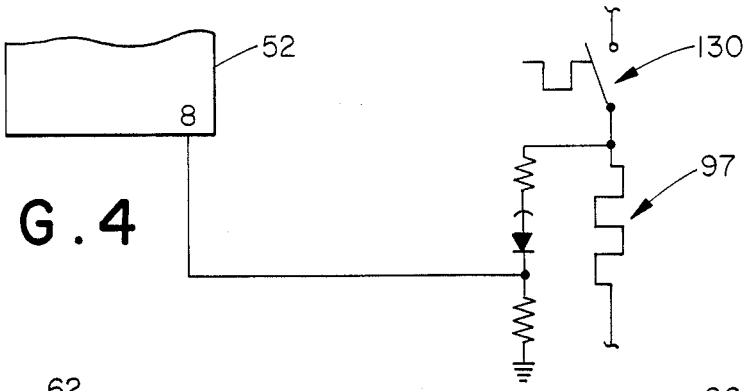
FIG. 4 is an alternative embodiment of the control circuit particularly illustrating an alternative circuit for sensing an end of a defrost period; and, FIG. 5 is a plan view of a control panel of a refrigerator for the subject invention including diagrammatic illustrations of components for implementing the refrigeration control of the present invention.

The microprocessor comprised an LC6505 and the op-amps comprised an LM324. An alternative embodiment of the invention is shown in FIG. 4. Here, the defrost temperature sensor thermistor 56 was replaced in favor of a thermostat control switch 130 linked to pin 8 of the microprocessor for control of the defrost heater 97.

Figure 5:
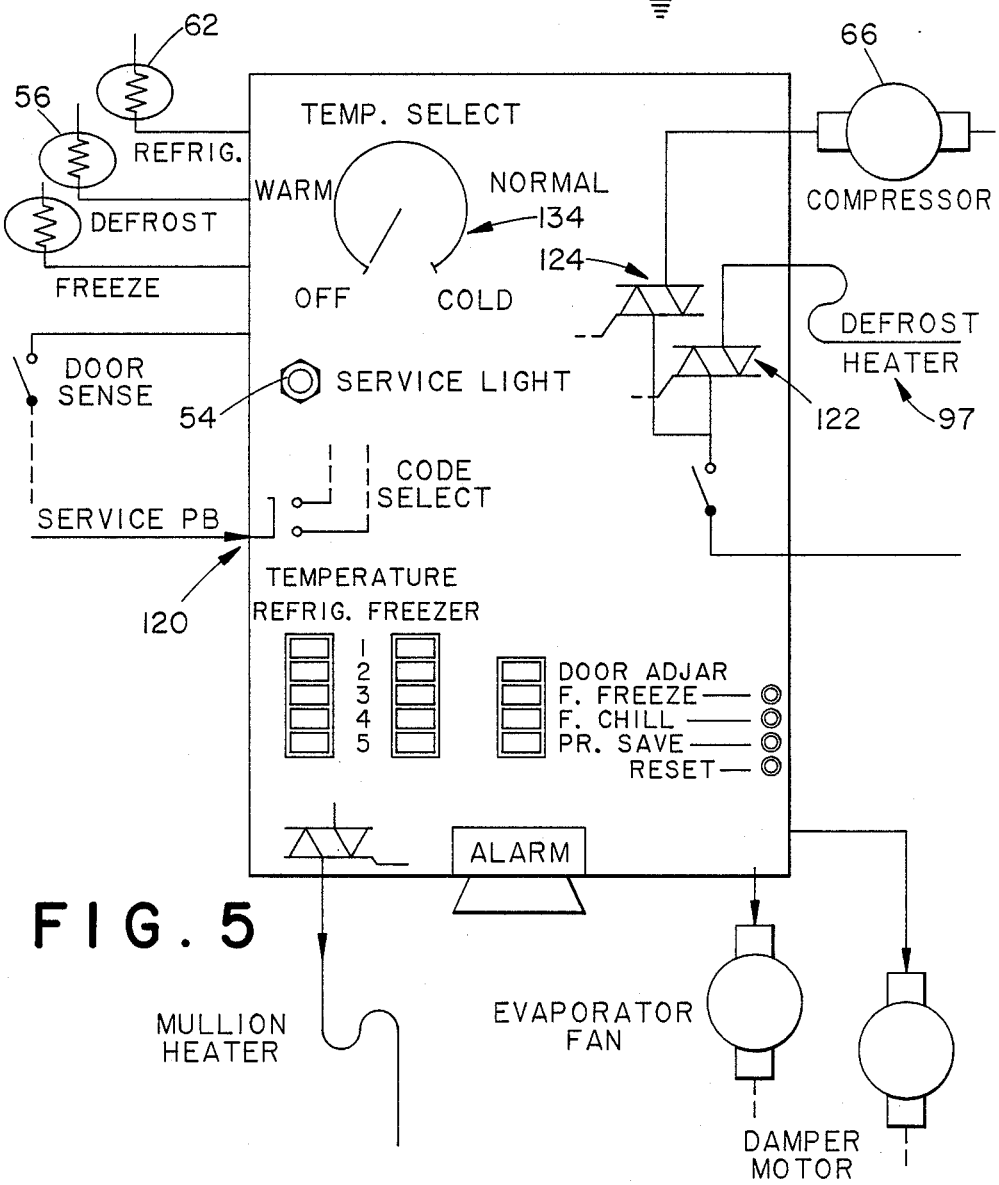

With reference to FIG. 5, the microprocessor 52 includes a plurality of ports for temperature comparisons. The ports defined by pins 41, and 10 are activated to provide a voltage on the inverted input of the operational amplifler comparator 64. The port identified by pin 9 is also activated to provide a voltage on the non-inverting input of the comparitor 64 for allowing thermistor 62 to exist in a voltage divider with resistors R1 and R10. The analog comparison is then made and sensed by the port identified by pin 12 of the microprocessor 52. Similar means are utilized for the defrost temperature sensor 56, as well as other temperature set points represented by resistors R4, R5, R6, and R7. Pins 1 and 2 comprise thermostat open or short circuits. Pin 7 comprises a sensor 56 open circuit. The selection of these pin resistors are set such that the thermistors 56, 62 and the thermostat potentiameter 60 can also be checked by the microprocessor 52 for shorted or open conditions to provide a failure indication.

With particular reference to FIG. 5, a typical operator panel formed in accordance with the present invention is illustrated. The panel includes a temperature select adjustment 134 operatively linked to the potentiameter 60 at a conveniently visible service light 54.

The invention has been described with reference to the preferred and alternative embodiments. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. A method of adjusting the period of a defrost interval in a refrigerator comprising:

electronically detecting a parameter directly relating to and representing the time period of a defrost operation in the refrigerator;

comparing said parameter with a source of signals representing predetermined defrost period limits, said period limits comprising a plurality of preselected defrost operation periods including a preferred period and non-preferred periods;

generating an output control signal in response to a predetermined relationship between said parameter and said source of signals; and, adjusting the defrost interval in response to said control signal when the defrost operating time falls within a non-preferred period said adjusting comprising setting the interval to a preselected minimum base interval when the defrost operation time period is greater than a preselected maximum non-preferred period; decreasing the interval by a preselected adjustment time period when the defrost operation time period is greater than the preferred period and less than the maximum non-preferred period; repeating the defrost interval when the defrost operation time period falls within the preferred period; and, increasing the interval by the preselected adjustment time period when the defrost operation time period is less than the preferred period, said increasing being limited by a maximum base defrost interval period whereby the defrost interval period is maintained within a preferred preselected time period.

2. A method of adjusting the period of a defrost interval in a refrigerator comprising:

providing a sensing means for providing an output signal representative of the temperature of a refrigerator compartment; and a thermostat means for providing control signals indicative of the refrigerator compartment;

continuously comparing the output and control signals for detecting a parameter directly relating to and representing the time period of a defrost operation in the refrigerator;

continuously verifiying the operability of the sensing means and thermostat means;

comparing said parameter with a source of signals representing predetermined defrost period limits, said period limits comprising a plurality of preselected defrost operation periods including a preferred period and non-preferred periods;

generating an output control signal in response to a predetermined relationship between said parameter and said source of signals; and, adjusting the defrost interval in response to said control signal when the defrost operating time falls within a non-preferred period said adjusting comprising setting the interval to a preselected minimum base interval when the defrost operation time period is greater than a preselected maximum non-preferred period; decreasing the interval by a preselected adjustment time period when the defrost operation time period is greater than the preferred period and less than the maximum non-preferred period; repeating the defrost interval when the defrost operation time period falls within the preferred period; and, increasing the interval by the preselected adjustment time when the defrost operation time period is less than the preferred period, said increasing being limited by a maximum base defrost interval period whereby the defrost interval is maintained within a preferred preselected time period.

* * * * *